US008808802B2

(12) United States Patent
Feng et al.

(10) Patent No.: US 8,808,802 B2
(45) Date of Patent: Aug. 19, 2014

(54) METHOD FOR PREPARING A COATING RESISTANT TO CONTACT CORROSION ON THE SURFACE OF TITANIUM ALLOY

(75) Inventors: Lixin Feng, Jiangsu (CN); Minyan Zhang, Jiangsu (CN); Pingze Zhang, Jiangsu (CN)

(73) Assignee: Jiangsu Linlong New Materials Co., Ltd., Rongdong Village, Yuqi Town, Huishan, Wuxi, Jiangsu (CN)

( * ) Notice: Subject to any disclaimer, the term of this patent is extended or adjusted under 35 U.S.C. 154(b) by 711 days.

(21) Appl. No.: 13/127,214

(22) PCT Filed: Mar. 31, 2010

(86) PCT No.: PCT/CN2010/071483

§ 371 (c)(1),
(2), (4) Date: May 2, 2011

(87) PCT Pub. No.: WO2011/079554

PCT Pub. Date: Jul. 7, 2011

(65) Prior Publication Data

US 2011/0300374 A1 Dec. 8, 2011

(30) Foreign Application Priority Data

Dec. 28, 2009 (CN) ..... 2009 1 0262712

(51) Int. Cl.
*B05D 3/02* (2006.01)

(52) U.S. Cl.
USPC ..... 427/372.2

(58) Field of Classification Search
USPC ..... 427/372.2
See application file for complete search history.

(56) References Cited

U.S. PATENT DOCUMENTS

| | | | | |
|---|---|---|---|---|
| 3,000,755 | A * | 9/1961 | Hanink et al. | 148/535 |
| 3,937,858 | A * | 2/1976 | Thiele | 427/431 |
| 5,789,089 | A * | 8/1998 | Maki et al. | 428/623 |
| 2004/0173466 | A1 * | 9/2004 | Burca et al. | 205/210 |
| 2011/0293467 | A1 * | 12/2011 | Feng et al. | 420/519 |
| 2012/0224993 | A1 * | 9/2012 | Feng et al. | 420/532 |
| 2012/0263972 | A1 * | 10/2012 | Feng et al. | 428/686 |

FOREIGN PATENT DOCUMENTS

| | | | |
|---|---|---|---|
| JP | 06116748 | A * | 4/1994 |
| JP | 07258813 | A * | 10/1995 |
| WO | PCT/CN2010/071483 | | 9/2010 |

OTHER PUBLICATIONS

Smolenskaya et al., "Electroplating of Titanium", Nov. 1960, Metal Science and Heat Treatment of Metals, vol. 2 Issue 11, pp. 615-616.*
Wu, Shuiqing "Application of Glycol in Electroplating Industry" Electroplating & Finishing vol. 14, No. 2 Jun. 1995, p. 48-51.*

* cited by examiner

*Primary Examiner* — Nathan Empie
(74) *Attorney, Agent, or Firm* — Tianhua Gu; Global IP Services

(57) ABSTRACT

The invention relates to a method for preparing a coating resistant to contact corrosion on the surface of titanium alloy, which comprises the following steps: 1. carrying out degreasing and derusting to a titanium alloy part; 2. carrying out etching treatment on the titanium alloy part; 3. carrying out surface activation treatment on the titanium alloy part; 4. preheating the titanium alloy part in an atmosphere protection furnace; 5. immersing the preheated titanium alloy part in plating solution; and 6. carrying out diffusion treatment on the immersion-plated titanium alloy part in a vacuum furnace whereby atoms at the interface diffuse to form a diffusion layer on a substrate and thus form a plating diffusion composite layer on the surface of the titanium alloy part. The part treated by the method completely solves the problem of contact corrosion of titanium alloy contacting with aluminum alloy and steel material.

8 Claims, No Drawings

METHOD FOR PREPARING A COATING RESISTANT TO CONTACT CORROSION ON THE SURFACE OF TITANIUM ALLOY

CROSS REFERENCE TO RELATED PATENT APPLICATION

The present application is the U.S. national stage of PCT/2010/071,483 filed on Mar. 31, 2010, which claims the priority of the Chinese patent application No. 200910262712.X filed on Dec. 28, 2009, which application is incorporated herein by reference.

FIELD OF THE INVENTION

The invention relates to a method for preparing a coating resistant to contact corrosion on the surface of titanium alloy.

BACKGROUND OF THE INVENTION

Titanium alloy becomes important aeronautical material for its high strength, strong corrosion resistance, etc. The use of the titanium alloy is significant for reducing the weight of a plane and improving the performance of the plane. Although having favorable corrosion resistance, titanium alloy is liable to contact corrosion resulting in failure under synergetic effect of stress and environment when titanium alloy contacts with aluminum alloy and alloy steel.

Contact corrosion is galvanic corrosion, namely that when dissimilar metals are in contact in the same media, due to different electrode potentials the metal with lower electrode potential melts preferentially to another resulting in local corrosion of the contacting part of the metal. The essential measure for controlling contact corrosion is to appropriately carry out surface modification and surface coating treatment through reasonable material selection to make the electrode potentials of dissimilar materials of contacting members nearly equal so as to reduce or eliminate contact corrosion. In aviation industry, main measures for preventing contact corrosion between titanium alloy and its connecting structure includes various surface engineering technologies. In one measure, the surfaces of materials are modified by chemical plating, electroplating, and the like, whereby the electrode potentials of the contacting materials are nearly equal to effectively prevent galvanic corrosion. For instance, all titanium alloy fasteners of a B767 airliner are treated with ion plating aluminum before contacting with aluminum alloy, so that the galvanic effect of titanium-aluminum is reduced; anodic oxidation or chemical conversion coating treatment is another way for reducing contact corrosion of titanium alloy contacting with aluminum contacting and alloy steel. Painting or glue coating is also an important method for preventing contact corrosion between titanium alloy and other metals, such as epoxy zinc yellow primer, XM-33-4 two-component sealant protection, which can prevent galvanic corrosion when 0Cr13Ni8Mo2Al contacts with LY12 and TC4.

Though there have been certain achievements in preventing contact corrosion of titanium alloy at home and abroad, the above current measures have some problems. The common problem lies in that the coating obtained by the above method is easy to flake off under the action of contact corrosion, and abrasive wear is generated among contacting parts due to flaked pieces, so that the failure of the parts is aggravated to cause completely loss of the protective effect of the coating. In addition, the technical measures of the prior art have high cost and is limited to the size and the shape of a work piece to be processed, thereby having great limitation, and a large number of fasteners of a plane are in urgent need to solve the problem of failure caused by contact corrosion.

SUMMARY OF THE INVENTION

In view of the problems of the prior art, the invention provides a method for preparing a coating resistant to contact corrosion on the surface of titanium alloy to completely solve the problem of contact corrosion of titanium alloy contacting with aluminum alloy and steel material.

The invention provides a method for preparing a coating resistant to contact corrosion on the surface of titanium alloy, comprising:

a first step: carrying out degreasing and derusting to a titanium alloy part;

a second step: carrying out etching treatment on the titanium alloy part;

a third step: carrying out surface activation treatment on the titanium alloy part;

a fourth step: preheating the titanium alloy part in an atmosphere protection furnace;

a fifth step: immersing the preheated titanium alloy part in plating solution in a way that the part is rotated in the submerging process;

a sixth step: carrying out diffusion treatment on the immersion-plated titanium alloy part in a vacuum furnace whereby atoms at the interface diffuse to form a diffusion layer on a substrate and thus form a plating diffusion composite layer on the surface of the titanium alloy part and thereby realizing metallurgical combination between the coating and the substrate.

Preferably, in the first step, rust on the surface of the part is removed by blasting sand mortar, the abrasive size of said sand mortar is 0.1-0.15 mm, the sand blasting lasts for 10-20 minutes, and after sand blasting, the part is finely polished through mechanical lapping, then is ultrasonically cleaned in acetone solution, and is finally rinsed by deionized water.

Preferably, during said etching treatment of the second step, the part after degreasing and derusting is put in mixed solution of hydrochloric acid and hydrofluoric acid for etching 1-3 minutes at room temperature and is rinsed by deionized water, wherein said hydrochloric acid HCl accounts for 94-96% and said hydrofluoric acid accounts for 4-6% of the mixed solution in volume.

Preferably, the treating temperature of said surface activation treatment of the third step is 40-60° C., the treatment time lasts for 30-40 min, and formula of activation solution of said surface activation treatment is as follows:

| | |
|---|---|
| Ethylene glycol $C_2H_6O_2$ | 600-900 ml/L |
| Ammonium hydrogen fluoride $NH_4HF_2$ | 25-45 g/L |
| Nickel chloride $NiCl_2$—$6H_2O$ | 10-30 g/L |
| Boric acid $H_3BO_3$ | 20-60 g/L |
| Lactic acid $C_3H_6O_3$ | 10-35 ml/L |
| Acetic acid $C_2H_4O_2$ | 70-230 ml/L |

Preferably, in the fourth step, said part is preheated at 600-700° C. in the atmosphere protection furnace for 10-20 minutes.

Preferably, in the fifth step, the preheated part is immersed in the plating solution for 1-5 minutes, wherein said plating solution mainly contains Al, Si, Zn, rare earth elements, microalloy elements and nanometer oxide particle reinforcing agent, said microalloy elements are selected from one of or more than one of Mg, Fe, Cu, Mn, Cr and Zr, said nanometer oxide particle reinforcing agent is selected form one or two of $TiO_2$ and $CeO_2$, and the mass percentage of the components of the plating solution is as follows: Si: 8-24%, Zn: 1.2-3.1%, rare earth elements: 0.02-0.5%, total content of the microalloy elements: 0.02-0.5%, total content of the nanometer oxide particle reinforcing agent: 1-2%, and Al: the balance.

More preferably, the average particle size of said nanometer oxide particle reinforcing agent is 15-60 nm.

More preferably, the specific mass percentages of the total of said microalloy elements are as follows: Mg: 0.5-3.2%, Fe: 0.05-1%, Cu: 0.05-0.5%, Mn: 1.0-2.0%, Cr: 0.5-2.0%, and Zr: 0.02-0.5%.

Preferably, in the sixth step, the immersion-plated part is put into a vacuum furnace at 500-600° C. for preservation 2-5 hours, and the thickness of said diffusion layer is 10-30 μm.

In another aspect, the invention provides a titanium alloy part with a surface coating resistant to contact corrosion. The thickness of said coating is 200-300 μm, said coating contains a diffusion layer formed through the diffusion of atoms at the interface on a substrate, the metallurgical combination between the coating and the substrate is achieved via the diffusion layer, the thickness of the diffusion layer is 10-30 μm, and said diffusion layer is formed through the following processes:

a first step: carrying out degreasing and derusting to a titanium alloy part;

a second step: carrying out etching treatment on the titanium alloy part;

a third step: carrying out surface activation treatment on the titanium alloy part;

a fourth step: preheating the titanium alloy part in an atmosphere protection furnace;

a fifth step: immersing the preheated titanium alloy part in plating solution in a way that the part is rotated in the submerging process;

a sixth step: carrying out diffusion treatment on the soaked titanium alloy part in a vacuum furnace whereby atoms on the interface diffuse to form a diffusion layer on a substrate and thus form a plating diffusion composite layer on the surface of the titanium alloy part and thereby realizing metallurgical combination between the coating and the substrate.

In the invention, pretreatment of immersion plating is an important means to improve the bonding strength of the coating and the substrate and is an important step to improve the contact corrosion resistance of the coating, wherein the surface activation treatment on the part before immersion plating substantially eliminates the risk of activation solution corroding the part and reduces environmental pollution by replacing fluoboric acid and hydrofluoric acid of the prior art, thereby protecting environments and saving energy. In addition, the immersion-plated part being put into the atmosphere protection furnace for preheating for a while before the immersion plating reduces mechanical property mismatch between the coating and the substrate, so that the coating can not flake off even under the action of a contact fretting load.

On the other hand, in view of the defect that the common coating on the surface of titanium alloy part of the prior art easily flakes off to lose anticorrosion function caused by contact corrosion, the coating formed by the plating solution of the invention has good corrosion and wear resistance and favorably metallurgic combination with the substrate, and thus can prevent contact corrosion between the titanium alloy part and aeronautical materials such as aluminum alloy, high-temperature alloy, etc.

Moreover, in the invention, the step of diffusion treatment is additionally provided after the immersion plating to reduce the mechanical property mismatch between the coating and the substrate material, so that the coating is further bonded firmly with the substrate, and can not easily flake off under the action of contact corrosion and thus has better protection effect.

In conclusion, with the improvement on coating materials and coating processes, a coating having good corrosion and ware resistance and favorable combination with a substrate is formed on the surface of titanium alloy. The electrode potential of the coating is nearly equal to materials such as aluminum alloy, etc. to prevent contact corrosion between a titanium alloy part and aeronautical materials such as aluminum alloy, high-temperature alloy and the like. In addition, the invention has simple process and low production cost, is suitable for parts with different shapes and sizes, thereby completely solving the problem of contact corrosion of titanium alloy contacting with aluminum alloy and steel material and having significance for further widening the application of titanium alloy to aviation field and improving the performance of a plane.

DETAILED DESCRIPTIONS OF THE INVENTION

The invention provides a method for preparing a coating resistant to contact corrosion on the surface of titanium alloy, comprising:

a first step: carrying out degreasing and derusting to a titanium alloy part;

a second step: carrying out etching treatment on the titanium alloy part;

a third step: carrying out surface activation treatment on the titanium alloy part;

a fourth step: preheating the titanium alloy part in an atmosphere protection furnace;

a fifth step: immersing the preheated titanium alloy part in plating solution in a way that the part is rotated in the submerging process;

a sixth step: carrying out diffusion treatment on the immersion-plated titanium alloy part in a vacuum furnace whereby atoms at the interface diffuse to form a diffusion layer on a substrate and thus form a plating diffusion composite layer on the surface of the titanium alloy part and thereby realizing metallurgical combination between the coating and the substrate.

Prefer embodiments of the method for preparing a coating resistant to contact corrosion on the surface of a titanium alloy part, while it should be specially explained that the conditions given by the following embodiments are not described as essential technical features, and those skilled in the art can carry out reasonable generalization and deduction on the basis of the values listed in the embodiments.

Embodiment 1

(1) After degreasing, a part undergoes derusting treatment through liquid blasting, the abrasive size is 0.1 mm, and the blasting time lasts for 20 minutes. After blasting, the part is finely polished through mechanical lapping, then is ultrasonically cleaned in acetone solution, and is finally rinsed by deionized water.

(2) After degreasing and derusting, the part is put in mixed solution of 94% of hydrochloric acid HCl in volume and 6% hydrofluoric acid HF in volume for etching 1 minute at room temperature and is rinsed by deionized water.

(3) The part goes through activation treatment in mixed solution of ethylene glycol, ammonium hydrogen fluoride, nickel chloride, boric acid, lactic acid and acetic acid for 40 minutes at 40° C., is rinsed by deionized water and dried.

(4) The part treated in (1)-(3) is put into an atmosphere protection furnace and is preheated for 10 minutes at 700° C.

(5) In the atmosphere protection furnace, the preheated titanium alloy part is immersed in plating solution for 1 minute in a way that the part is rotated in the submerging process.

(6) The immersion-plated part is put into a vacuum furnace and preserved for 5 hours at 500° C. whereby a plating diffusion composite layer is formed on the surface of the titanium alloy.

Embodiment 2

(1) After degreasing, apart undergoes derusting treatment through liquid blasting, the abrasive size is 0.1 mm, and the blasting time lasts for 20 minutes. After blasting, the part is finely polished through mechanical lapping, then is ultrasonically cleaned in acetone solution, and is finally rinsed by deionized water.

(2) After degreasing and derusting, the part is put in mixed solution of 94% of hydrochloric acid HCl in volume and 6% hydrofluoric acid HF in volume for etching 1 minute at room temperature and is rinsed by deionized water.

(3) The part goes through activation treatment in mixed solution of ethylene glycol, ammonium hydrogen fluoride, nickel chloride, boric acid, lactic acid and acetic acid for 40 minutes at 40° C., is rinsed by deionized water and dried.

(4) The part treated in (1)-(3) is put into an atmosphere protection furnace and is preheated for 10 minutes at 700° C.

(5) In the atmosphere protection furnace, the preheated titanium alloy part is immersed in plating solution for 1 minute in a way that the part is rotated in the submerging process.

(6) The immersion-plated part is put into a vacuum furnace and preserved for 5 hours at 500° C. whereby a plating diffusion composite layer is formed on the surface of the titanium alloy.

Embodiment 3

(1) After degreasing, apart undergoes derusting treatment through liquid blasting, the abrasive size is 0.12 mm, and the blasting time lasts for 15 minutes. After blasting, the part is finely polished through mechanical lapping, then is ultrasonically cleaned in acetone solution, and is finally rinsed by deionized water.

(2) After degreasing and derusting, the part is put in mixed solution of 95% of hydrochloric acid HCl in volume and 5% hydrofluoric acid HF in volume for etching 2 minute at room temperature and is rinsed by deionized water.

(3) The part goes through activation treatment in mixed solution of ethylene glycol, ammonium hydrogen fluoride, nickel chloride, boric acid, lactic acid and acetic acid for 35 minutes at 50° C., is rinsed by deionized water and dried.

(4) The part treated in (1)-(3) is put into an atmosphere protection furnace and is preheated for 15 minutes at 650° C.

(5) In the atmosphere protection furnace, the preheated titanium alloy part is immersed in plating solution for 3 minute in a way that the part is rotated in the submerging process.

(6) The immersion-plated part is put into a vacuum furnace and preserved for 3 hours at 550° C. whereby a plating diffusion composite layer is formed on the surface of the titanium alloy.

In the embodiments 1-3, the activation solution for surface activation treatment has the following components and contents thereof shown in table 1. It should be specially explained that table 1 merely shows prefer embodiments of the components and the contents of the activation solution of the invention, but the components and the contents of the activation solution of the invention are not limited to the values listed in the table, and those skilled in the art can carry out reasonable generalization and deduction on the basis of the values listed in the table. Therefore, the following embodiments are described as more prefer conditions instead of essential conditions of the invention.

TABLE 1

Activation Solution Formula, Components and Contents Per 1 Liter, the Balance of Water

| | Components | | | | | |
|---|---|---|---|---|---|---|
| Serial number | Ethylene glycol (ml) | Ammonium hydrogen fluoride (g) | Nickel chloride (g) | Boric acid (g) | Lactic acid (ml) | Acetic acid (g) |
| 1 | 600 | 45 | 30 | 60 | 35 | 230 |
| 2 | 620 | 43 | 28 | 40 | 31 | 225 |
| 3 | 660 | 41 | 24 | 35 | 27 | 210 |
| 4 | 680 | 39 | 22 | 45 | 24 | 200 |
| 5 | 700 | 35 | 20 | 50 | 20 | 180 |
| 6 | 760 | 32 | 18 | 30 | 18 | 150 |
| 7 | 810 | 29 | 16 | 25 | 15 | 120 |
| 8 | 860 | 27 | 13 | 22 | 12 | 100 |
| 9 | 900 | 25 | 10 | 20 | 10 | 70 |

In the embodiments 1-3, the components and the contents of the plating solution are shown in table 2. It should be specially explained that table 2 merely shows prefer embodiments of the plating solution of the invention, although the microalloy elements in table 2 include Mg, Fe, Cu, Mn, Cr and Zr, this is not described as necessary technical features. The microalloy elements of the invention can be selected from one or more than one of Mg, Fe, Cu, Mn, Cr and Zr. Similarly, although table 2 shows the nanometer oxide particle reinforcing agent is $TiO_2$, the nanometer oxide particle reinforcing agent of the invention can be $CeO_2$ or both.

TABLE 2

Mass Percentage (%) of the Components of the Total

| Serial | Element | | | | | | | | | | |
|---|---|---|---|---|---|---|---|---|---|---|---|
| number | Al | Si | Zn | RE | Mg | Fe | Cu | Mn | Cr | Zr | $TiO_2$ |
| 1 | balance | 24 | 1.98 | 0.02 | 1.0 | 0.05 | 0.1 | 1.0 | 0.5 | 0.1 | 1.0 |
| 2 | balance | 22 | 1.95 | 0.05 | 1.5 | 0.2 | 0.2 | 1.2 | 0.6 | 0.2 | 1.05 |
| 3 | balance | 21 | 1.9 | 0.08 | 1.92 | 0.3 | 0.3 | 1.3 | 0.7 | 0.3 | 1.1 |
| 4 | balance | 20 | 1.85 | 0.1 | 1.9 | 0.4 | 0.4 | 1.4 | 0.8 | 0.4 | 1.15 |
| 5 | balance | 19 | 1.8 | 0.12 | 1.88 | 0.5 | 0.5 | 1.5 | 0.9 | 0.5 | 1.2 |
| 6 | balance | 17 | 1.85 | 0.15 | 2.7 | 0.6 | 0.05 | 1.6 | 1.0 | 0.02 | 1.3 |
| 7 | balance | 16 | 1.82 | 0.18 | 2.6 | 0.7 | 0.2 | 1.7 | 1.1 | 0.2 | 1.4 |
| 8 | balance | 15 | 1.5 | 0.2 | 2.8 | 0.8 | 0.3 | 1.8 | 1.2 | 0.3 | 1.5 |
| 9 | balance | 13 | 2.75 | 0.25 | 2.4 | 0.9 | 0.4 | 1.9 | 1.3 | 0.4 | 1.6 |
| 10 | balance | 11 | 2.8 | 0.30 | 3.2 | 1.0 | 0.5 | 1.8 | 1.4 | 0.5 | 1.7 |
| 11 | balance | 12 | 1.2 | 0.32 | 2.68 | 0.9 | 0.1 | 1.7 | 1.5 | 0.08 | 1.8 |

TABLE 2-continued

| Serial number | Mass Percentage (%) of the Components of the Total | | | | | | | | | | |
|---|---|---|---|---|---|---|---|---|---|---|---|
| | Element | | | | | | | | | | |
| | Al | Si | Zn | RE | Mg | Fe | Cu | Mn | Cr | Zr | $TiO_2$ |
| 12 | balance | 10 | 3 | 0.35 | 0.8 | 0.8 | 0.2 | 1.6 | 1.6 | 0.2 | 1.85 |
| 13 | balance | 10 | 3.1 | 0.40 | 0.6 | 0.7 | 0.3 | 1.5 | 1.7 | 0.3 | 1.90 |
| 14 | balance | 9 | 2.95 | 0.45 | 0.65 | 0.6 | 0.4 | 1.4 | 1.8 | 0.4 | 1.95 |
| 15 | balance | 8 | 3.0 | 0.5 | 0.5 | 0.5 | 0.5 | 1.3 | 1.9 | 0.5 | 2 |

In another aspect, the invention further provides a titanium alloy part with a surface coating resistant to contact corrosion. The thickness of said coating is 200-300 μm, said coating contains a diffusion layer formed through the diffusion of atoms at the interface on a substrate, the metallurgical combination between the coating and the substrate is achieved via the diffusion layer, the thickness of the diffusion layer is 10-30 μm, and said diffusion layer is formed through the following processes:

a first step: carrying out degreasing and derusting to a titanium alloy part;

a second step: carrying out etching treatment on the titanium alloy part;

a third step: carrying out surface activation treatment on the titanium alloy part;

a fourth step: preheating the titanium alloy part in an atmosphere protection furnace;

a fifth step: immersing the preheated titanium alloy part in plating solution in a way that the part is rotated in the submerging process;

a sixth step: carrying out diffusion treatment on the soaked titanium alloy part in a vacuum furnace whereby atoms on the interface diffuse to form a diffusion layer on a substrate and thus form a plating diffusion composite layer on the surface of the titanium alloy part and thereby realizing metallurgical combination between the coating and the substrate.

Prefer embodiments of the coating resistant to contact corrosion of the invention are given in table 3:

TABLE 3

| Serial number | Thickness Unit (μm) | | | |
|---|---|---|---|---|
| | Thickness of coasting | Thickness of diffusion layer | Bonding force of coating | Contact corrosion resistance |
| 1 | 200 | 10 | Level 1 | better |
| 2 | 210 | 11 | Level 1 | excellent |
| 3 | 220 | 13 | Level | excellent |
| 4 | 235 | 16 | Level | excellent |
| 5 | 250 | 19 | Level | excellent |
| 6 | 260 | 21 | Level | excellent |
| 7 | 270 | 25 | Level | excellent |
| 8 | 290 | 28 | Level | excellent |
| 9 | 300 | 30 | Level 2 | excellent |

Note:
method for testing bonding force of coating is carried out by referring to GB1720-79

In conclusion, the foregoing prefer embodiments are merely illustrative of the invention, but the concept of the invention are not to be construed in a limiting sense, and non-essential modifications of the invention on this basis are seen to fall within the scope of the invention.

What is claimed is:

1. A method for preparing a contact corrosion resistant coating on a surface of titanium alloy part comprising:

first step, carrying out degreasing and derusting to a titanium alloy part;

second step, carrying out etching treatment on the titanium alloy part;

third step, carrying out surface activation treatment on the titanium alloy part;

fourth step, preheating the titanium alloy part in an atmosphere protection furnace;

fifth step, submerging the preheated titanium alloy part in plating solution, turning the part during the submerging process; wherein in the fifth step, the preheated part is immersed in the plating solution for 1-5 minutes, wherein said plating solution mainly contains Al, Si, Zn, rare earth elements, microalloy elements and nanometer oxide particle reinforcing agent, wherein said microalloy elements are selected from one of or more than one of Mg, Fe, Cu, Mn, Cr and Zr, and said nanometer oxide particle reinforcing agent is selected from one or two of TiO.sub.2 and CeO.sub.2, and the mass percentage of the components of the plating solution is as follows: Si: 8-24%, Zn: 1.2-3.1%, rare earth elements: 0.02-0.5%, total content of the microalloy elements: 0.02-5.0%, total content of the nanometer oxide particle reinforcing agent: 1-2%, Al: the remainder; and sixth step, carrying out diffusion treatment, put the immersion-plated titanium alloy part in a vacuum furnace, atoms at an interface diffuse to form a diffusion layer on a substrate and thus form a plating diffusion composite layer on the surface of the titanium alloy part and thereby realizing metallurgical combination between the coating and the substrate.

2. The method of claim 1, wherein in the first step, rust on the surface of the part is removed by sand mortar blasting which lasts for 10-20 minutes, wherein abrasive size of said sand mortar is 0.1-0.15 mm, and after sand blasting, the part is finely polished through mechanical lapping, then is ultrasonically cleaned in acetone solution, and is finally rinsed by deionized water.

3. The method of claim 1, wherein during said etching treatment of the second step, the part after degreasing and derusting is put in mixed solution of hydrochloric acid and hydrofluoric acid to etch 1-3 minutes at room temperature and is rinsed by deionized water, wherein said hydrochloric acid (HCl) accounts for 94-96% and said hydrofluoric acid (HF) accounts for 4-6% of the mixed solution in volume.

4. The method of claim 1, wherein in said surface activation treatment of the third step, the treatment temperature is 40-60° C., the treatment time lasts for 30-40 min, and the formula of activation solution is as follows:

| | |
|---|---|
| Ethylene glycol $C_2H_6O_2$ | 600-900 ml/L |
| Ammonium hydrogen fluoride $NH_4HF_2$ | 25-45 g/L |
| Nickel chloride $NiCl_2$—$6H_2O$ | 10-30 g/L |

-continued

| | |
|---|---|
| Boric acid $H_3BO_3$ | 20-60 g/L |
| Lactic acid $C_3H_6O_3$ | 10-35 ml/L |
| Acetic acid $C_2H_4O_2$ | 70-230 ml/L |

5. The method of claim 1, wherein in the fourth step, said part is preheated at 600-700° C. in the atmosphere protection furnace for 10-20 minutes.

6. The method of claim 1, wherein the average particle size of said nanometer oxide particle reinforcing agent is 15-60 nm.

7. The method of claim 1, wherein the specific mass percentages of the total of said microalloy elements are as follows: Mg: 0.5-3.2%, Fe: 0.05-1%, Cu: 0.05-0.5%, Mn: 1.0-2.0%, Cr: 0.5-2.0%, and Zr: 0.02-0.5%.

8. The method of claim 1, wherein in the sixth step, the immersion-plated part is put into a vacuum furnace at 500-600° C. for 2-5 hours preservation, and the thickness of said diffusion layer is 10-30 μm.

* * * * *